US005655730A

United States Patent [19]

Beisswanger et al.

[11] Patent Number: 5,655,730

[45] Date of Patent: Aug. 12, 1997

[54] PAPER MACHINE CARRIER DRUM APPARATUS

[75] Inventors: Rudolf Beisswanger, Steinheim; Karl Rück, Heidenheim; Hanspeter Elger, Mülheim/Ruhr, all of Germany

[73] Assignee: Voith Sulzer Papiermaschinen GmbH, Heidenheim, Germany

[21] Appl. No.: 759,322

[22] Filed: Dec. 2, 1996

Related U.S. Application Data

[63] Continuation of Ser. No. 371,761, Jan. 12, 1995, abandoned.

[30] Foreign Application Priority Data

Jan. 15, 1994 [DE] Germany ..... 44 01 027.3

[51] Int. Cl.[6] ..... B65H 18/16

[52] U.S. Cl. ..... 242/542.3; 242/541.5; 242/547

[58] Field of Search ..... 242/541, 541.4, 242/542, 542.3, 542.4, 547

[56] References Cited

U.S. PATENT DOCUMENTS

| | | | |
|---|---|---|---|
| 1,923,670 | 8/1933 | Henson et al. . | |
| 2,915,255 | 12/1959 | Phelps . | |
| 2,984,426 | 5/1961 | Johnson | 242/542.3 |
| 3,549,098 | 12/1970 | Helkala | 242/542.4 |
| 3,750,973 | 8/1973 | Walters | 242/542.4 |
| 3,869,095 | 3/1975 | Diltz | 242/542.4 |
| 4,179,330 | 12/1979 | Page . | |
| 4,193,559 | 3/1980 | Ballard | 242/547 |
| 4,487,377 | 12/1984 | Perini | 242/542.4 |
| 4,491,283 | 1/1985 | Pav et al. | 242/547 |
| 4,541,585 | 9/1985 | Frye et al. | 242/542.4 |
| 4,909,452 | 3/1990 | Hertel et al. | 242/542 |
| 5,056,730 | 10/1991 | Bückle | 242/547 |
| 5,184,787 | 2/1993 | Holzinger et al. . | |

FOREIGN PATENT DOCUMENTS

| | | | |
|---|---|---|---|
| 19 35 584 | 1/1971 | Germany . | |
| 74 13 286 | 9/1974 | Germany . | |
| 24 23 227 | 11/1975 | Germany | 242/547 |
| 41 23 761 | 1/1993 | Germany . | |
| 1 297 812 | 11/1972 | United Kingdom . | |
| 2 226 304 | 6/1990 | United Kingdom | 242/542.4 |
| WO94/29205 | 12/1994 | WIPO | 242/542 |

OTHER PUBLICATIONS

Voith Tragtrommelroller (Carrier Drum Reed) Brochure No. 1736 (Jun. 20, 1973; Germany).

*Primary Examiner*—John P. Darling
*Attorney, Agent, or Firm*—Marshall, O'Toole, Gerstein, Murray & Borun

[57] ABSTRACT

A paper machine carrier drum apparatus includes a drivable carrier drum and a cylinder disposed adjacent the carrier drum. The cylinder is disposed parallel to an axis of the carrier drum and can be swiveled about a peripheral region of the drum. The apparatus also includes a guide roll disposed upstream of the carrier drum with respect to a direction of travel of a paper web through the apparatus and a pressure roll disposed adjacent to the drum and adjustably pressable thereagainst. The pressure roll can be moved to a number of positions about a periphery of the drum.

5 Claims, 2 Drawing Sheets

PAPER MACHINE CARRIER DRUM APPARATUS

This is a continuation of U.S. application Ser. No. 08/371,761, filed Jan. 12, 1995, now abandoned.

BACKGROUND OF THE INVENTION

1. Field of the Invention

The invention relates to paper making machines and in particular to an apparatus for winding a traveling paper web produced on a paper making machine.

2. Description of Related Technology

Carrier drum apparatus, also known as carrier drum reels, are known from the following publications:

(1) DE-GM 74 13 286;

(2) DE-OS 19 35 584;

(3) U.S. Pat. No. 2,915,255;

(4) U.S. Pat. No. 4,179,330;

(5) DE 41 23 761;

(6) Company Brochure "Voith Carrier Drum Reel", No. 1736; 1 67 3000; (6/20/73);

(7) DE-PS 40 07 329 C2;

(8) GB 1 297 812; and (9) U.S. Pat. No. 1,923,670.

Carrier drum reels disclosed in the publications noted herein form the final group of a paper machine. They are utilized to wind up a finished paper web into a roll. In such an apparatus, a cylinder is used as the roll core. The cylinder is disposed parallel to a carrier drum and is supported with its bearing journals in forks of swivelable levers so that the cylinder can be swiveled about a portion of a periphery of the carrier drum. The cylinder may be positioned adjacent to the carrier drum in an upper apex region thereof. When a first portion of a paper web is wound on the cylinder, the cylinder is swung horizontally around about one quadrant of the carrier drum, preferably in a direction of removal of the paper from the paper machine.

Publication (1) discloses a drivable carrier drum cooperating with a cylinder disposed parallel to the carrier drum. The cylinder is swivelable about a periphery of the drum. A guide roll is disposed upstream of the carrier drum with reference to a direction of movement of a paper web through the paper machine. Publication (1) also discloses a pressure roll cooperating with the drum and pressing thereagainst.

From publication (2) it is known that by the combination of a carrier drum and a pressure roll, a slip-free transport of a paper web is possible.

Historically, the major consideration with regard to carrier drum reels of the type mentioned herein has been the quality of winding. It is believed that the fact that other paper properties might also be influenced significantly by the carrier drum reel has not been considered.

An important consideration in the making of paper, particularly graphic papers, is low dust contamination. Dust is highly undesirable, especially for the subsequent paper finishing processes and during printing. Although there are devices for removing dust from paper, it is desirable to produce the paper during the manufacturing process in such a way that as little dust as possible is produced. A classical method of dust reduction is to add adhesive to the paper pulp suspension before the paper machine or to spray the paper with an adhesive-like substances in the paper machine. However, this requires additional expenditure and does not always bring about the desired success.

The carrier drum reel can be a considerable source of dust under certain circumstances. In particular, slippage can occur between the surface of the carrier drum and the paper web looped around it and thus the side of the paper web facing the drum surface will be subjected to friction. Since at this point of the paper making process the paper web has a high dry content, typically about 97%, abrasion of the paper web may occur. This is especially inconvenient in the case of coated paper because the coating of the paper facing the drum surface can be abraded, which can lead to a paper Web having two differently textured sides. Also, in the case of highly filled papers, i.e., papers with a high filler content, abrasion can be especially disadvantageous.

Although it has previously been known that web slippage is disadvantageous (see publication (2)), so far it has not been known that the production of dust can be promoted by slippage of a paper web on a carrier drum.

A winding machine disclosed in DE 41 34 648 shows a paper web pressed against a supporting roll 8 with the aid of a free-running roll. In such an arrangement, the tension of the paper web before the winding stations is supposed to be interrupted.

SUMMARY OF THE INVENTION

It is an object of the invention to overcome one or more of the problems described above. It is also an object of the invention to avoid abrasion and dust on a paper web being wound by a carrier drum reel.

According to the invention, a paper machine carrier drum apparatus includes a drivable carrier drum and a cylinder disposed adjacent the carrier drum. The cylinder is disposed parallel to an axis of the carrier drum and can be swiveled about a peripheral region of the drum. The apparatus also includes a guide roll disposed upstream of the carrier drum with respect to a direction of travel of a paper web through the apparatus. Also according to the invention, a pressure roll is disposed adjacent to the drum and adjustably pressable thereagainst. The pressure roll is movable to a plurality of positions about a periphery of the drum.

Other objects and advantages of the invention will be apparent to those skilled in the art from the following detailed description taken in conjunction with the drawings and the appended claims.

DETAILED DESCRIPTION OF THE INVENTION

Figure 1:
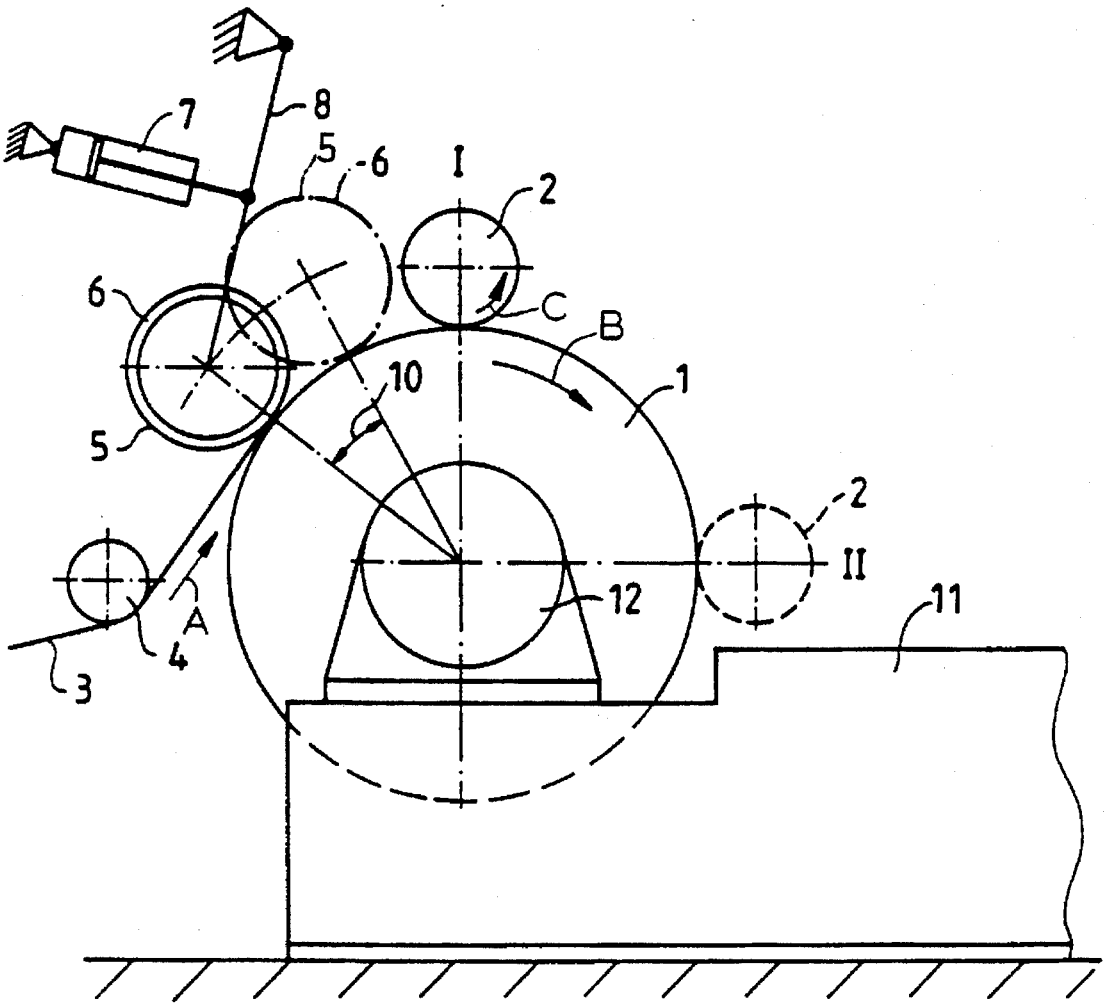
FIG. 1 is a partially schematic sectional view of an apparatus according to the invention.

A carrier drum apparatus or reel according to the invention is shown in FIG. 1. The carrier drum apparatus is disposed at a downstream end of a paper machine (not otherwise shown) with respect to a direction of travel of a paper web through the machine. The carrier drum apparatus includes a carrier drum 1 having a drive (not shown) and a cylinder 2 disposed at an upper apex of the carrier drum 1. The cylinder 2 is shown in a position I. The cylinder 2 can be displaced to a position II shown in phantom in a peripheral region of the drum 1. The swiveling of the cylinder 2 is performed with a pair of levers (not shown). The two levers are disposed at two front faces of the carrier drum 1. The levers can be swiveled around the axis of the carrier drum 1 and each has a fork at its free end that accepts axle journals of the cylinder 2. The cylinder 2 performs the actual paper web winding work in the position II.

As a paper web 3 exits a dryer part of the paper machine (not shown) disposed upstream of the drum 1, the web first loops about a spreader roll 4 and then travels in a direction indicated by an arrow A to a surface of the carrier drum 1. The web 3 loops about the surface of the carrier drum 1 at a certain angle until it reaches the cylinder 2. As can be seen from FIG. 1, the web 3 travels directly between the spreader roll 4 and the carrier drum 1 without contacting any other felt or roll. Such an unsupported draw of the web between the spreader roll 4 and the drum 1 is known in the art of papermaking as a "free draw." At the cylinder 2, the winding process begins in a known manner, in which a beginning piece or portion of the paper web 3 is wound around the cylinder 2. An arrow B indicates a direction of rotation of the carrier drum 1 and an arrow C indicates a direction of rotation of the cylinder 2. For the purpose of winding, the cylinder 2 is put into rotation, however, this will not be described in further detail herein.

According to the invention, a pressure roll 5 is provided. The pressure roll 5 preferably has a coating or covering 6 made of relatively soft material, that may also be elastic, for example, rubber. The pressure roll 5 can be selectively pressed against the surface of the carrier drum 1 by a pivoting rod 8 connected to the roll 5 and to a pneumatic drive 7. The rod 8 is attached to the roll 5 at one end thereof and anchored to the paper machine at the other end thereof. The pneumatic drive 7 is connected to the rod 8 at a central portion thereof. As can be seen, the pressure roll 5 can also be displaced about a periphery of the carrier drum 1 to a second position shown in phantom. An angle of pivoting 10 of the roll 5 as shown in FIG. 1 is about 30°.

Thus, according to the invention, the pressure roll 5 can be disposed in a plurality of positions about a peripheral region of the carrier drum 1 as defined by the angle of pivoting 10, i.e, in a plurality of positions defined by an angle of pivoting up to and including the angle 10 shown in FIG. 1.

According to the invention, the pressure roll can be placed at a given angle with respect to the carrier drum, thus, various paper thicknesses can be accommodated. Adjustment of the correct angle is a question of optimization, which can be answered in practice.

The pressure roll 5 can be coated with an anti-adhesion coating. The pressing pressure can be selected so that a line of force between the surface of the pressure roll 5 and the carrier drum 1 is the same as the weight of the pressure roll 5 itself, or it can be smaller or larger than this weight.

In order to avoid the paper web 3 enveloping the pressure roll 5 when the paper web 3 becomes torn, the surface 6 of the roll 5 can be provided with radial bores through which compressed air can be blown in a direction toward the paper web so that adherence of the paper web 3 onto the pressure roll 5 or the surface 6 thereof is prevented. Similarly, a vacuum may be pulled through such radial bores in order to aspirate a boundary air layer between the coated surface 6 of the arriving paper web 3.

The carrier drum 1 can also have a rubber coating and, in addition, can be provided with bores around its surface so that reduced pressure can be applied in order to aspirate the boundary air layer between the drum 1 and the arriving paper web 3.

In another embodiment of an apparatus according to the invention, the pressure roll 5 is designed as a sagging-compensation roll so that a change of the pressing force in a pressing gap between the pressure roll 5 and the carrier drum 1 can be individually adjusted.

Figure 2:
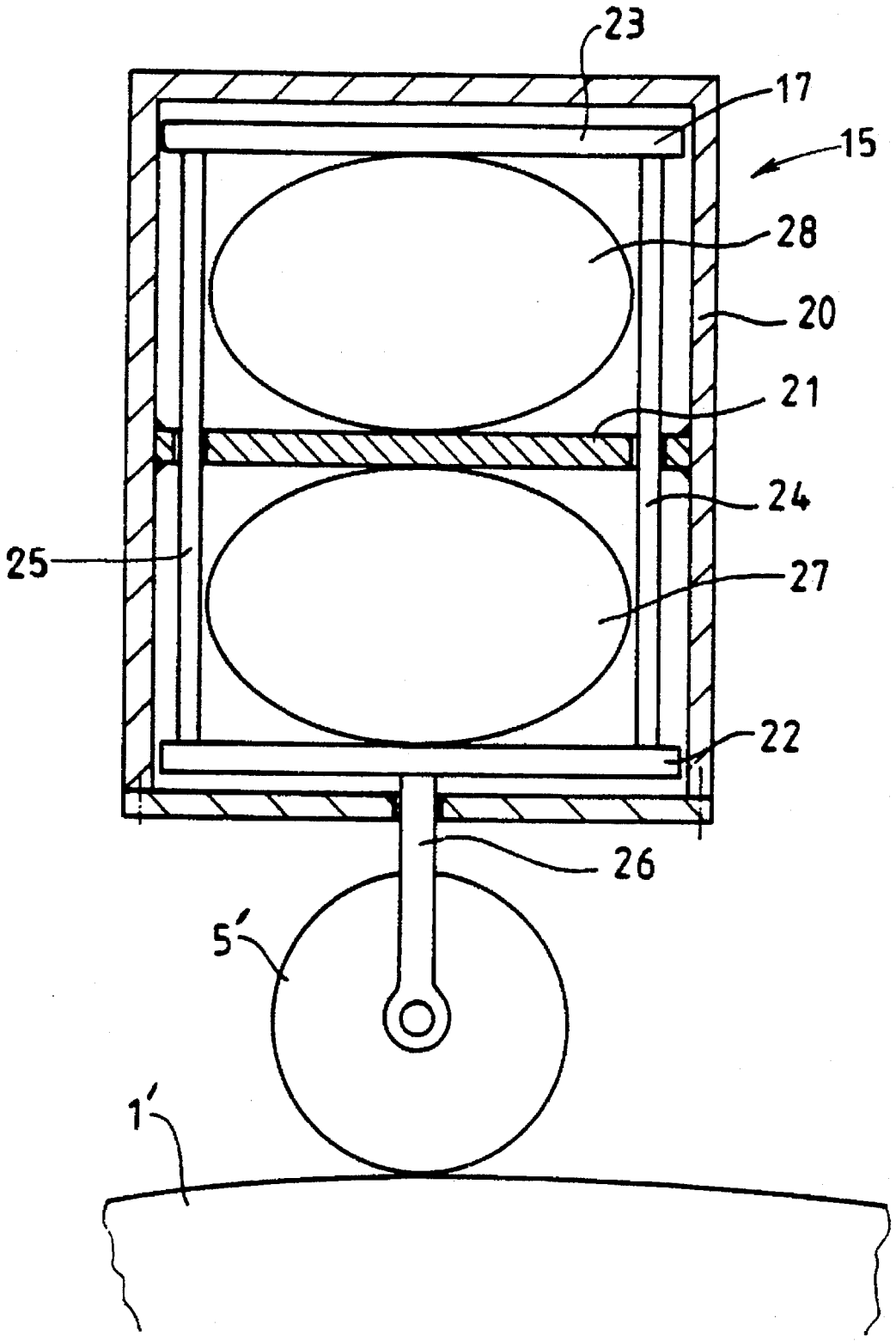
FIG. 2 is an enlarged partially schematic sectional view of a second embodiment of an apparatus according to the invention.

FIG. 2 shows an apparatus according to the invention having a carrier drum 1', as well as a pressure roll 5' similar to the drum 1 and pressure roll 5, respectively, disclosed herein with respect to FIG. 1. FIG. 2 shows a pressing system according to the invention that can be used as an alternative to the pneumatic drive 7 and pivoting rod 8 shown in FIG. 1. FIG. 2 shows a differential pressure system, generally 15, including a fixed housing 20 subdivided by a fixed plate 21, and a sled 17 having a lower plate 22, an upper plate 23, and tension rods 24 and 25 spanning between the plates 22 and 23. The plate 22 is attached to a connecting rod 26 which is also attached to the roll 5'. The two tension rods 24 and 25 pass through bores in the fixed plate 21, so that the sled 17 can move up and down, thereby acting on the pressure roll 5 with the aid of the connecting rod 26. The movement of the sled 17 is produced by bellows 27 and 28 disposed within the sled 17, one at either side of the fixed plate 21. The bellows 27 and 28 can be driven pneumatically or hydraulically.

The foregoing detailed description is given for clearness of understanding only, and no unnecessary limitations should be understood therefrom, as modifications within the scope of the invention will be apparent to those skilled in the art.

We claim:

1. A paper machine carrier drum apparatus comprising:

a drivable carrier drum having an axis;

a cylinder disposed adjacent the carrier drum, said cylinder disposed parallel to the carrier drum axis and swivelable about a first peripheral region of the drum;

a guide roll disposed upstream of the carrier drum with respect to a direction of travel of a paper web through the apparatus; and a pressure roll disposed adjacent to said drum and adjustably pressable against said drum, said pressure roll movable to a plurality of positions about a second peripheral region of the drum, the pressure roll and the drivable carrier drum defining a nip for passage of a material web therethrough, the drivable carrier drum, the guide roll, and the pressure roll oriented with respect to one another to provide a free draw of a material web directly between the guide roll and the nip defined by the pressure roll and the drivable carrier drum.

2. The carrier drum apparatus of claim 1 wherein said guide roll is a spreader roll.

3. The carrier drum apparatus of claim 1 wherein the pressure roll has a surface made of an elastic material.

4. The carrier drum apparatus of claim 1 wherein a surface of the pressure roll has bores optionally connected to at least one of a source of pressure and a source of vacuum.

5. The carrier drum apparatus of claim 1 wherein a surface of the drum has bores connected to a source of vacuum.

* * * * *